US011590773B2

(12) United States Patent
Kawamichi et al.

(10) Patent No.: US 11,590,773 B2
(45) Date of Patent: Feb. 28, 2023

(54) SHEET CONVEYOR, SHEET HEATER, LIQUID DISCHARGE APPARATUS, AND PRINTER THAT REDUCE SHEET DEFORMATION VIA MULTIPLE SUPPORTS

(71) Applicants: Genichiroh Kawamichi, Ibaraki (JP); Masato Ogawa, Kanagawa (JP)

(72) Inventors: Genichiroh Kawamichi, Ibaraki (JP); Masato Ogawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/461,832

(22) Filed: Aug. 30, 2021

(65) Prior Publication Data

US 2022/0080749 A1 Mar. 17, 2022

(30) Foreign Application Priority Data

Sep. 16, 2020 (JP) ..... JP2020-155613

(51) Int. Cl.
*B41J 11/00* (2006.01)

(52) U.S. Cl.
CPC ..... *B41J 11/0021* (2021.01); *B41J 11/007* (2013.01); *B41J 11/0022* (2021.01)

(58) Field of Classification Search
CPC ... B41J 11/0021; B41J 11/0022; B41J 11/007; B41J 11/002; B41J 11/0085; B41J 13/08; B65H 2406/31; B65H 2406/322; B65H 2801/21; B65H 29/242; B65H 5/224
See application file for complete search history.

(56) References Cited

U.S. PATENT DOCUMENTS 6,394,596 B1 * 5/2002 Wotton ..... B65H 5/224 271/197
2008/0073838 A1 3/2008 Sakaida
2014/0232797 A1 8/2014 Onodera et al.
2015/0009252 A1 1/2015 Andoh et al.
2015/0174921 A1 6/2015 Onodera et al.
2015/0224802 A1 8/2015 Kawamichi et al.
2016/0273832 A1 9/2016 Asada et al.
2018/0264852 A1 9/2018 Ohtake et al.
2019/0047298 A1 2/2019 Hashimoto et al.
(Continued)

FOREIGN PATENT DOCUMENTS

JP 2009-297962 12/2009
JP 2010-046807 3/2010
(Continued)

OTHER PUBLICATIONS

European Search Report; Application EP21193014; dated Feb. 15, 2022.

*Primary Examiner* — Bradley W Thies
(74) *Attorney, Agent, or Firm* — Duft & Bornsen, PC

(57) ABSTRACT

A sheet conveyor includes a conveyance belt configured to convey a sheet on a first surface of the conveyance belt in a conveyance direction, a suction device configured to suck the sheet onto the conveyance belt via the conveyance belt, and multiple supports between the conveyance belt and the suction device in a vertical direction, the multiple supports configured to support a second surface of the conveyance belt. A longitudinal direction of each of the multiple supports is parallel to a direction intersecting the conveyance direction, and the multiple supports are arrayed in the conveyance direction.

11 Claims, 12 Drawing Sheets

(56) References Cited

U.S. PATENT DOCUMENTS

| | | | |
|---|---|---|---|
| 2019/0202215 | A1 | 7/2019 | Asada et al. |
| 2019/0204767 | A1 | 7/2019 | Ishihara et al. |
| 2021/0197584 | A1 | 7/2021 | Asada et al. |

FOREIGN PATENT DOCUMENTS

| | | |
|---|---|---|
| JP | 2015-217634 | 12/2015 |
| JP | 2018-154500 | 10/2018 |

* cited by examiner

COMPARATIVE EXAMPLE

COMPARATIVE EXAMPLE

COMPARATIVE EXAMPLE

SHEET CONVEYOR, SHEET HEATER, LIQUID DISCHARGE APPARATUS, AND PRINTER THAT REDUCE SHEET DEFORMATION VIA MULTIPLE SUPPORTS

CROSS-REFERENCE TO RELATED APPLICATION

This patent application is based on and claims priority pursuant to 35 U.S.C. § 119(a) to Japanese Patent Application No. 2020-155613, filed on Sep. 16, 2020, in the Japan Patent Office, the entire disclosures of which is hereby incorporated by reference herein.

BACKGROUND

Technical Field

Aspects of the present disclosure relate to a sheet conveyor, a sheet heater, a liquid discharge apparatus, and a printer.

Related Art

A printer applies a liquid onto a liquid application target such as a sheet. The printer includes a heater to heat the sheet on which the liquid has been applied while suctioning and conveying the sheet by a conveyance belt to accelerate drying of the liquid applied on the sheet.

SUMMARY

In an aspect of this disclosure, a sheet conveyor includes a conveyance belt configured to convey a sheet on a first surface of the conveyance belt in a conveyance direction, a suction device configured to suck the sheet onto the conveyance belt via the conveyance belt, and multiple supports between the conveyance belt and the suction device in a vertical direction, the multiple supports configured to support a second surface of the conveyance belt. A longitudinal direction of each of the multiple supports is parallel to a direction intersecting the conveyance direction, and the multiple supports are arrayed in the conveyance direction. The present embodiment can reduce deformation of the sheet.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
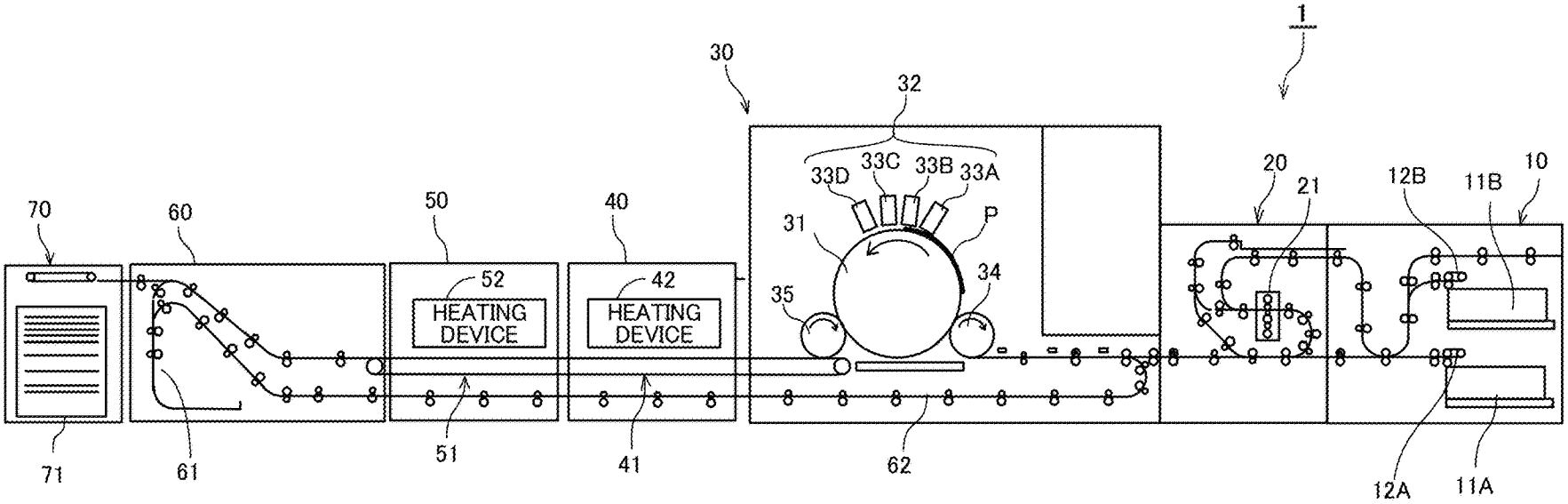
FIG. 1 is a schematic cross-sectional side view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Referring now to the drawings, wherein like reference numerals designate identical or corresponding parts throughout the several views, embodiments of the present disclosure are described below. A printer 1 as a liquid discharge apparatus according to a first embodiment of the present disclosure is described with reference to FIGS. 1 and 2.

FIG. 1 is a schematic side view of the printer 1 according to the first embodiment.

Figure 2:
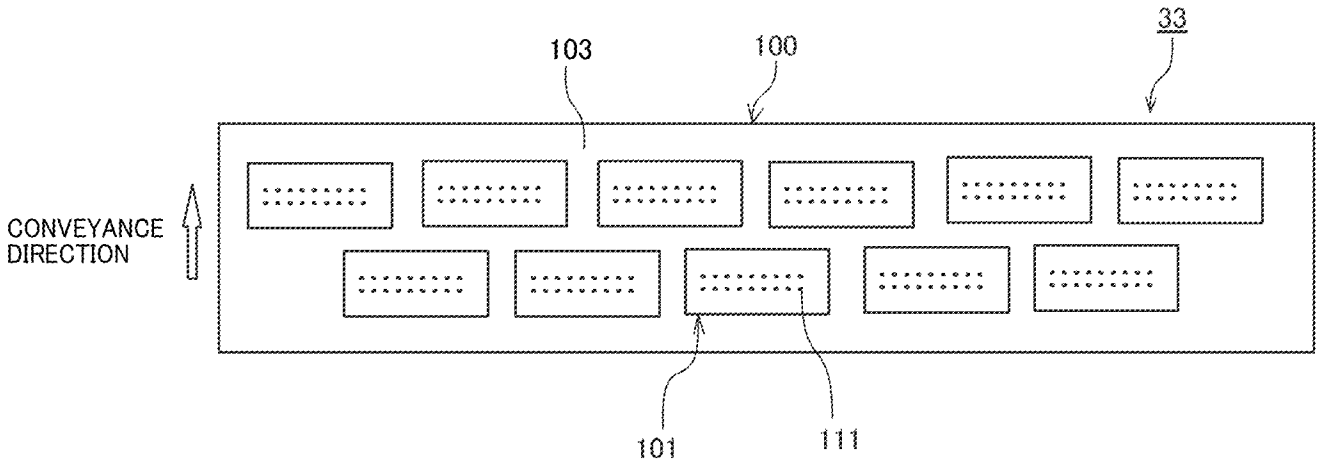
FIG. 2 is a plan view of a discharge unit of the printer.

FIG. 2 is a schematic plan view of a discharge unit of the printer 1.

The printer 1 according to the first embodiment includes a loading unit 10 to load a sheet P into the printer 1, a pretreatment unit 20, a printing unit 30, a first dryer 40, a second dryer 50, a reverse mechanism 60, and an ejection unit 70. The pretreatment unit 20 serves as a liquid applier to apply a pretreatment liquid onto the sheet P.

In the printer 1, the pretreatment unit 20 applies, as required, a pretreatment liquid as an application liquid onto the sheet P fed (supplied) from the loading unit 10, the printing unit 30 applies a desired liquid onto the sheet P to perform required printing.

After the printer 1 dries the liquid adhering to a front surface of the sheet P by the first dryer 40 and the second dryer 50, the printer 1 ejects the sheet P to the ejection unit 70 through the reverse mechanism 60 without printing on a back surface of the sheet P. The printer 1 may print the back surface of the sheet P after the printer 1 dries the liquid adhering to the front surface of the sheet P by the first dryer 40 and the second dryer 50 and conveys the sheet P to an upstream end of the printing unit 30 via the reversing mechanism 60, and the printer 1 then ejects the sheet P printed on both surfaces to the ejection unit 70.

The loading unit 10 includes loading trays 11 (a lower loading tray 11A and an upper loading tray 11B) to accommodate a plurality of sheets P and feeding devices 12 (a feeding device 12A and a feeding device 12B) to separate and feed the sheets P one by one from the loading trays 11. The loading unit 10 supplies the sheets P to the pretreatment unit 20.

The pretreatment unit 20 includes, e.g., a coater 21 as a treatment-liquid application unit that coats a printing surface of the sheet P with a treatment liquid having an effect of aggregation of ink particles to prevent bleed-through, for example.

The printing unit 30 includes a drum 31 and a liquid discharge device 32. The drum 31 is a bearer (rotating member) that bears the sheet P on a circumferential surface of the drum 31 and rotates. The liquid discharge device 32 discharges liquids toward the sheet P borne on the drum 31.

The printing unit 30 includes transfer cylinders 34 and 35. The transfer cylinder 34 receives the sheet P fed from the pretreatment unit 20 and forwards the sheet P to the drum 31. The transfer cylinder 35 receives the sheet P conveyed by the drum 31 and forwards the sheet P to the first dryer 40.

The transfer cylinder 34 includes a sheet gripper to grip a leading end of the sheet P conveyed from the pretreatment unit 20 to the printing unit 30. The sheet P thus gripped by the transfer cylinder 34 is conveyed as the transfer cylinder 34 rotates. The transfer cylinder 34 forwards the sheet P to the drum 31 at a position opposite (facing) the drum 31.

Similarly, the drum 31 includes a sheet gripper on a surface of the drum 31, and the leading end of the sheet P is gripped by the sheet gripper of the drum 31. The drum 31 includes a plurality of suction holes dispersed on a surface of the drum 31, and a suction unit generates suction airflows directed from desired suction holes of the drum 31 to an interior of the drum 31.

The sheet gripper of the drum 31 grips the leading end of the sheet P forwarded from the transfer cylinder 34 to the drum 31, and the sheet P is attracted to and borne on the drum 31 by the suction airflows by the suction device. As the drum 31 rotates, the sheet P is conveyed.

The liquid discharge device 32 includes discharge units 33 (discharge units 33A to 33D) to discharge liquids onto the sheet P as a liquid application device. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K). Further, a discharge unit 33 may discharge a special liquid, that is, a liquid of spot color such as white, gold, or silver.

As illustrated in FIG. 2, for example, each of the discharge unit 33 includes a head module 100 including a full line head. The head module 100 includes multiple liquid discharge heads 101 arranged in a staggered manner on a base 103. Each of the liquid discharge head 101 includes multiple nozzle rows, and multiple nozzles 111 are arranged in each of the nozzle rows. Hereinafter, the "liquid discharge head 101" is simply referred to as a "head 101".

The printing unit 30 controls a discharge operation of each discharge unit 33 of the liquid discharge device 32 by a drive signal corresponding to print data. When the sheet P borne on the drum 31 passes through a region facing the liquid discharge device 32, the liquids of respective colors are discharged from the discharge units 33 toward the sheet P, and an image corresponding to the print data is formed (printed) on the sheet P.

The first dryer 40 includes a heating device 42 such as an infrared (IR) heater. The heating device 42 irradiates the sheet P, to which the liquid has been applied, with infrared rays to heat and dry the sheet P conveyed by a conveyor 41. The second dryer 50 includes a heating device 52 such as an ultraviolet (UV) ray irradiator.

The heating device 52 of the second dryer 50 irradiates the sheet P applied with the liquid and passed through the first dryer 40 with infrared rays to heat and dry the sheet P conveyed by a conveyor 51. The conveyor 41 and the conveyor 51 may include a part of the same conveyance mechanism.

The reverse mechanism 60 includes a reverse part 61 and a duplex part 62. The reverse part 61 reverses the sheet P that has passed through the first dryer 40 and the second dryer 50 to dry a first surface of the sheet P onto which the liquid has been applied when the printer 1 performs a duplex printing. The duplex part 62 feeds the reversed sheet P back to upstream of the transfer cylinder 34 of the printing unit 30. The reverse part 61 reverses the sheet P by switchback manner.

The ejection unit 70 includes an ejection tray 71 on which a plurality of sheets P is stacked. The plurality of sheets P conveyed from the reverse mechanism 60 is sequentially stacked and held on the ejection tray 71.

The printer 1 according to the first embodiment prints the sheet P that is a cut sheet as an example. However, the printer 1 according to the first embodiments of the present disclosure can also be applied to an apparatus using a continuous medium (web) such as continuous paper or roll paper, an apparatus using a sheet material such as wallpaper, and the like.

A sheet heater 500 according to the first embodiment of the present disclosure is described with reference to FIGS. 3 and 4. The sheet heater 500 includes a sheet conveyor to convey the sheet P according to the first embodiment of the present disclosure.

Figure 3:
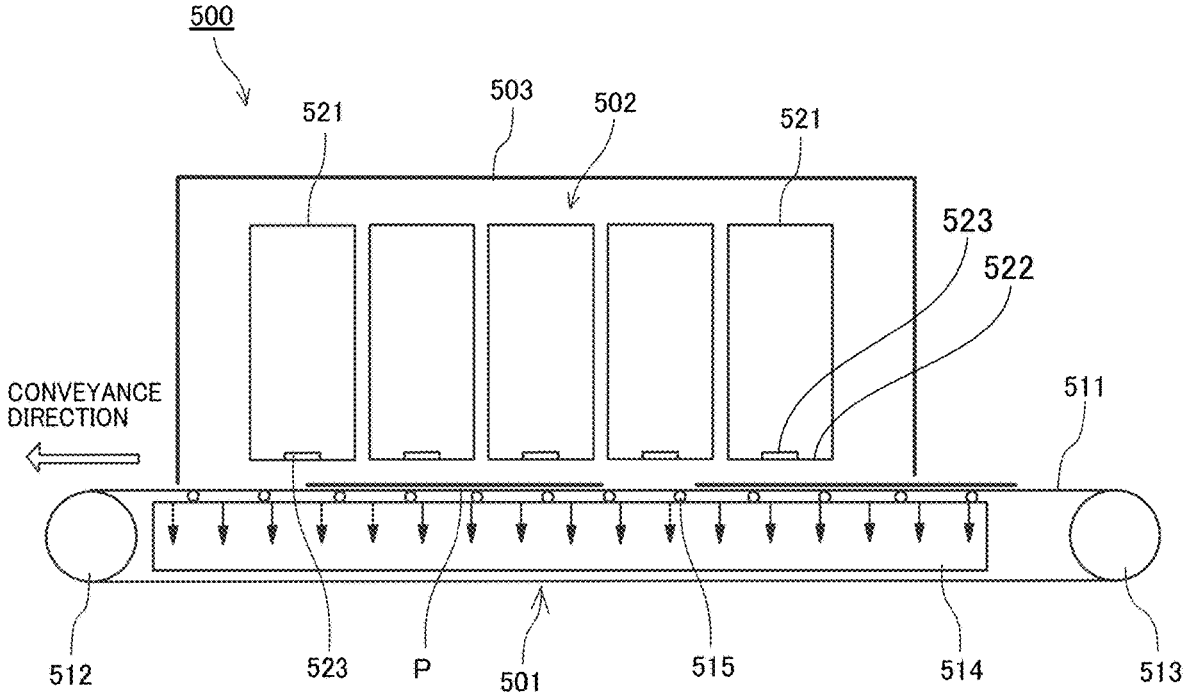
FIG. 3 is a schematic cross-sectional side view of a sheet heater according to the first embodiment of the present disclosure.

FIG. 3 is a schematic cross-sectional side view of the sheet heater 500 according to the first embodiment of the present disclosure.

Figure 4:
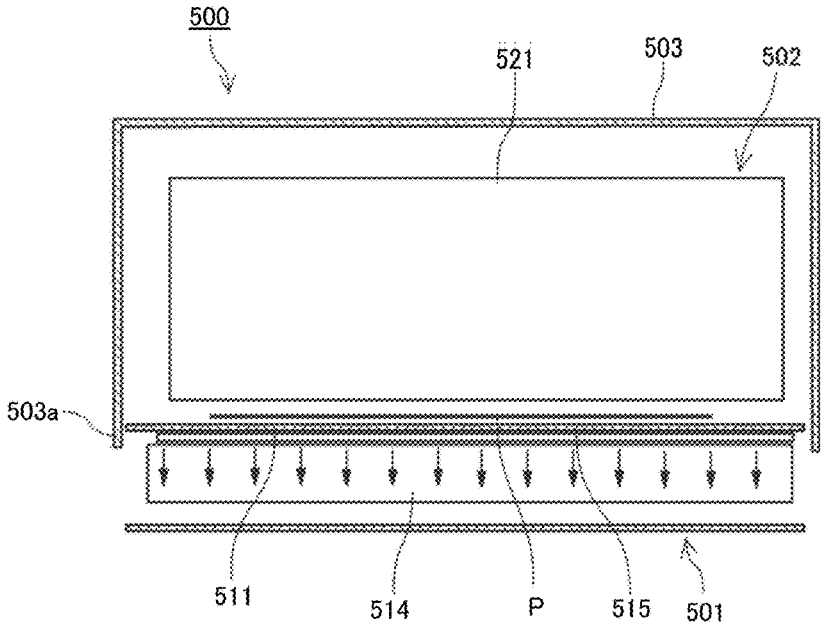
FIG. 4 is a schematic cross-sectional front view of the sheet heater of FIG. 3.

FIG. 4 is a schematic cross-sectional front view of the sheet heater 500 according to the first embodiment of the present disclosure.

The sheet heater 500 to heat the sheet P includes a conveyance mechanism 501 as a sheet conveyor to convey the sheet P and a heater 502 that configure the heating device 52.

The conveyance mechanism 501 includes a conveyance belt 511 that bears and conveys the sheet P. The conveyance mechanism 501 serves as a sheet conveyor. The conveyance belt 511 is an endless belt wound (stretched) between a drive roller 512 and a driven roller 513. The conveyance belt 511 rotates to move the sheet P. The conveyance mechanism 501 according to the first embodiment includes a mechanism to convey the sheet P from the printing unit 30 to the reverse mechanism 60 across the first dryer 40 and the second dryer 50 as illustrated in FIG. 1. The conveyance mechanism 501 includes the conveyors 41 and 51 in FIG. 1.

The conveyance belt 511 is a belt that includes multiple openings from which an air is sucked by a suction chamber 514 arranged inside the conveyance belt 511. The suction chamber 514 serves as a suction device. The conveyance belt 511 may be, for example, a mesh belt, a flat belt having suction holes (openings), or the like.

The suction chamber 514 vacuums the sheet P on the conveyance belt 511 through the openings of the conveyance belt 511. A suction force of the suction chamber 514 is generated by a suction device 505 (see FIG. 5) as described below. The suction chamber 514 may vacuum the sheet P by a suction blower, a fan, or the like.

The conveyance mechanism 501 includes multiple supports 515 between the conveyance belt 511 and the suction chamber 514. The suction chamber 514 serves as the suction device. The multiple supports 515 supports a back surface of the conveyance belt 511.

The multiple supports 515 extends in a direction intersecting the conveyance direction as indicated by arrow in FIG. 3. The multiple supports 515 are arranged side by side along the conveyance direction as illustrated in FIG. 3. Here, the multiple supports 515 may have a shape of, for example, a rod, a shaft, or a linear member. The multiple supports are columnar rods (bars) in FIG. 6. Further, the multiple supports 515 preferably have surfaces having a curvature (curved surfaces). The surfaces having a curvature contacts the conveyance belt 511. The multiple supports 515 have curved surfaces to reduce contact resistance between the conveyance belt 511 and the multiple supports 515.

The multiple supports 515 extend in a direction perpendicular to the conveyance direction (width direction) in the first embodiment. However, the multiple supports 515 may also extend obliquely with respect to the conveyance direction.

The heater 502 includes multiple ultraviolet irradiators 521 in a housing 503. The multiple ultraviolet irradiators 521 arranged in a housing 503 along the conveyance direction. The multiple ultraviolet irradiators 521 irradiate the sheet P conveyed by the conveyance mechanism 501 with ultraviolet rays to heat the sheet P.

As illustrated in FIG. 3, the housing 503 is arranged to have a gap with the conveyance belt 511 in a vertical direction, and the gap is formed along the conveyance direction of the sheet P. As illustrated in FIG. 4, the housing 503 includes an extension portion 503*a* extended lower than the conveyance belt 511 in a vertical (height) direction perpendicular to the conveyance direction of the sheet P.

The ultraviolet irradiator 521 includes granular ultraviolet light emitting diode elements 523 (UV-LED elements) arranged in a grid pattern on an irradiation surface 522 of the ultraviolet irradiator 521. Since the UV-LED elements 523 emit light at an identical illuminance, the ultraviolet irradiator 521 uniformly emits light along the irradiation surface 522 as a whole. As a wavelength of the ultraviolet light (UV light), a wavelength having a peak wavelength of 395 nm and a wavelength distribution having a full width at half maximum of about 15 nm is used.

Thus, the ultraviolet irradiator 521 can obtain an effect of selectively heating only an image part (a part onto which the liquid is applied) and not excessively raising a temperature of a blank part (a part onto which the liquid is not applied).

Next, details of the conveyance mechanism 501 (sheet conveyor) to convey the sheet P in the first embodiment is described with reference to FIGS. 5 to 7.

Figure 5:
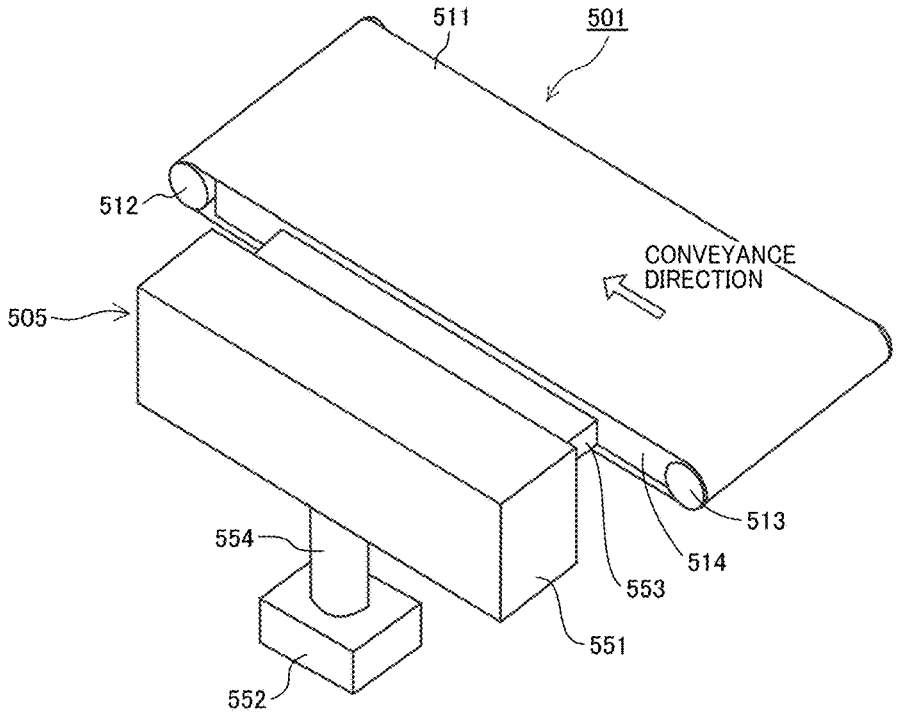
FIG. 5 is a schematic perspective view of a conveyance mechanism according to the first embodiment of the present disclosure.

FIG. 5 is a schematic perspective view of the conveyance mechanism 501.

Figure 6:
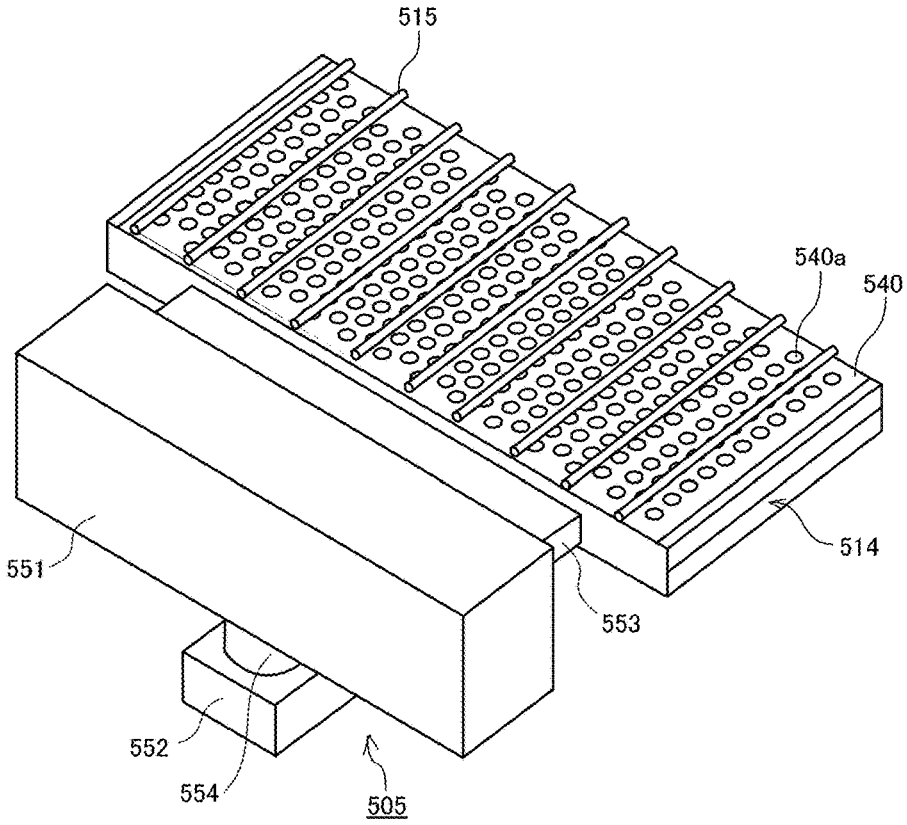
FIG. 6 is a schematic perspective view of a suction mechanism forming a part of the conveyance mechanism.

FIG. 6 is a schematic perspective view of the suction mechanism 504 forming a part of the conveyance mechanism 501.

Figure 7:
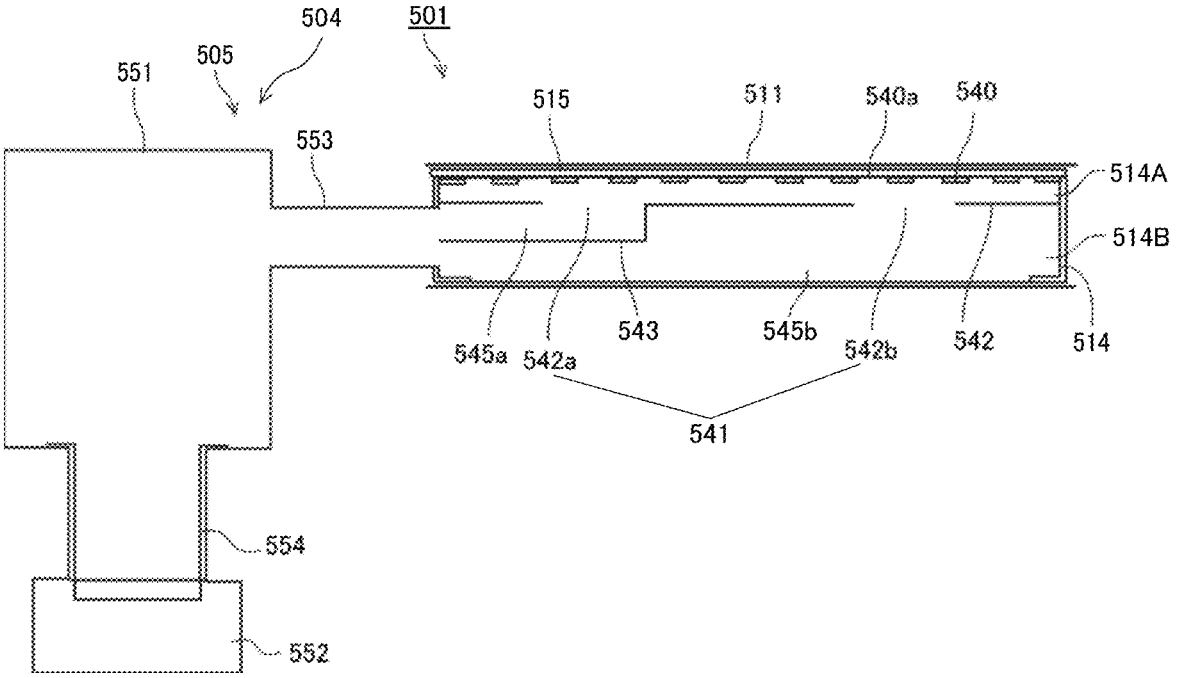
FIG. 7 is a cross-sectional front view of a suction chamber of the suction mechanism along a direction perpendicular to the conveyance direction.

FIG. 7 is a cross-sectional front view of the suction chamber 514 of the suction mechanism 504 along the direction perpendicular to the conveyance direction (width direction).

The conveyance mechanism 501 includes the conveyance belt 511, the suction chamber 514, and the suction device 505. The suction chamber 514 is disposed inside an inner space of the conveyance belt 511 so that the suction chamber 514 is surrounded by the conveyance belt 511. The suction device 505 vacuums air inside the suction chamber 514.

The suction device 505 is disposed on a side of the suction chamber 514 in the direction perpendicular to the conveyance direction (width direction). The suction device 505 vacuums an air inside the suction chamber 514.

The suction device 505 includes a decompression chamber 551 and a decompression device 552 that suctions an interior of the decompression chamber 551. The suction chamber 514 is coupled to the decompression chamber 551 with a duct 553. The duct 553 extends in a lateral (horizontal) direction. The decompression chamber 551 is coupled to the decompression device 552 with a duct 554. The duct 554 extends in a vertical direction.

The suction chamber 514 includes a suction port member 540 in an upper part of the suction chamber 514. The suction port member 540 has multiple suction ports 540*a*.

The suction chamber 514 includes a partition 542 below the suction port member 540 in the suction chamber 514. The partition 542 divides the suction chamber 514 into an upper chamber portion 514A and a lower chamber portion 514B. The partition 542 includes common suction ports 542*a* and 542*b* through which the multiple suction ports 540*a* commonly communicate with each other.

The multiple common suction ports 542*a* and 542*b* are through holes and are long holes longer (extending) in the conveyance direction. The multiple common suction ports 542*a* and 542*b* open at positions opposed to both end portions of the suction chamber 514 in the direction perpendicular to the conveyance direction of the sheet material P (width direction).

FIG. 7 illustrate an example in which a number of the common suction ports 542*a* and 542*b* is two. However, the number of the common suction ports may be one or three or more.

An opening area of each of the common suction ports 542*a* and 542*b* of the partition 542 is larger than an opening area of each of the multiple suction ports 540*a* of the suction port member 540.

The suction chamber 514 includes a channel member 543 coupled to the partition 542 to form suction channels 545*a* and 545*b*. The suction channel 545*a* connects the common suction port 542*a* to the duct 553 as a connection channel. The suction channel 545*b* connects the common suction port 542*b* to the duct 553.

The suction device 505 of the suction mechanism 504 is operated to suck an interior of the decompression chamber 551 to cause the interior of the decompression chamber 551 to a negative pressure state. Thus, the suction device 505 generates a negative pressure inside the decompression chamber 551 to suck an interior of the suction chamber 514 through the duct 553.

The suction device 505 sucks the interior of the suction chamber 514 to suck the lower chamber portion 514B. Thus, an air flow is generated in which air (gas) in the upper chamber portion 514A is sucked into the lower chamber portion 514B through the common suction ports 542*a* and 542*b*.

Accordingly, when the sheet P is on the conveyance belt 511, an internal pressure of the upper chamber portion 514A is reduced, and the sheet P is sucked and attracted onto the conveyance belt 511.

Figure 8:
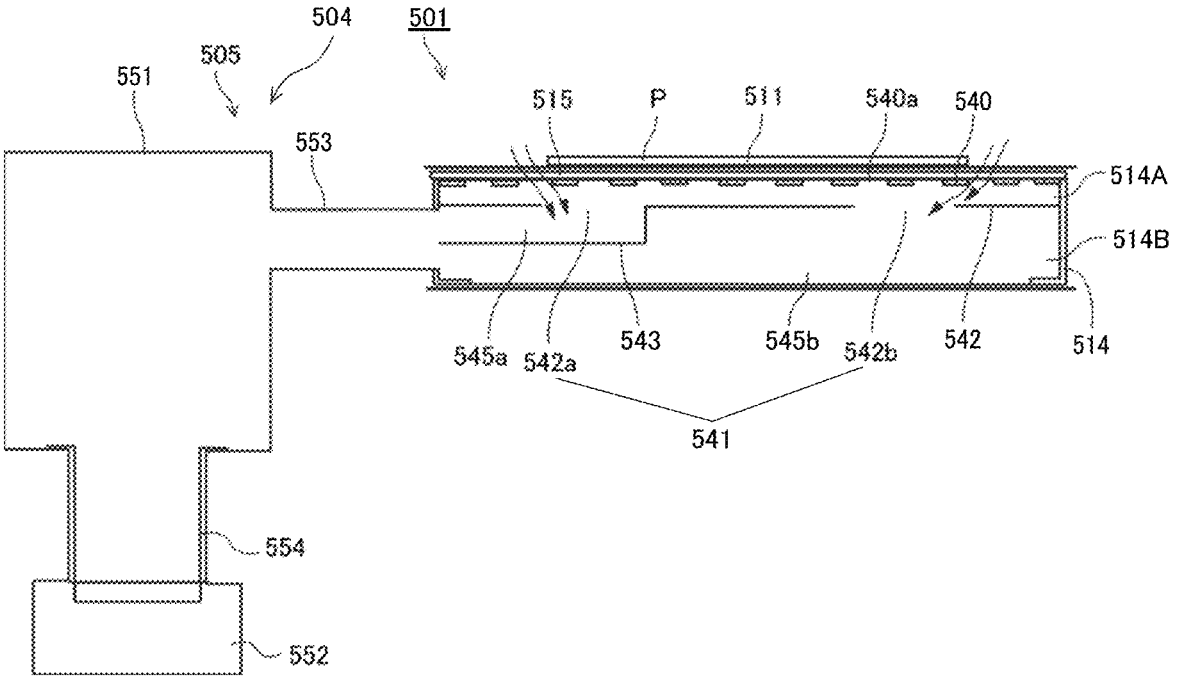
FIG. 8 is a cross-sectional front view of a suction chamber of the suction mechanism illustrating an effect of the suction mechanism.

A case in which the sheet P on the conveyance belt 511 has a size that does not completely cover an upper portion of the upper chamber portion 514A is described below. As indicated by arrow in FIG. 8, air flows into the upper chamber portion 514A from a portion not blocked by the sheet P through the openings of the conveyance belt 511.

The air flowing into the upper chamber portion 514A passes through the common suction ports 542*a* and 542*b* of the common suction port member 541, flows into the lower chamber portion 514B, and is sucked out from the suction chamber 514 to the decompression chamber 551 through the duct 553.

In the above-described manner, the suction device 505 is operated to suction air from the suction port 540*a*, and the sheet P is attracted to the conveyance belt 511. Thus, the sheet P is conveyed by a circulative movement of the conveyance belt 511.

Next, an effect of the sheet heater 500 according to the first embodiment is described with reference to FIGS. 9 to 11.

Figure 9A:
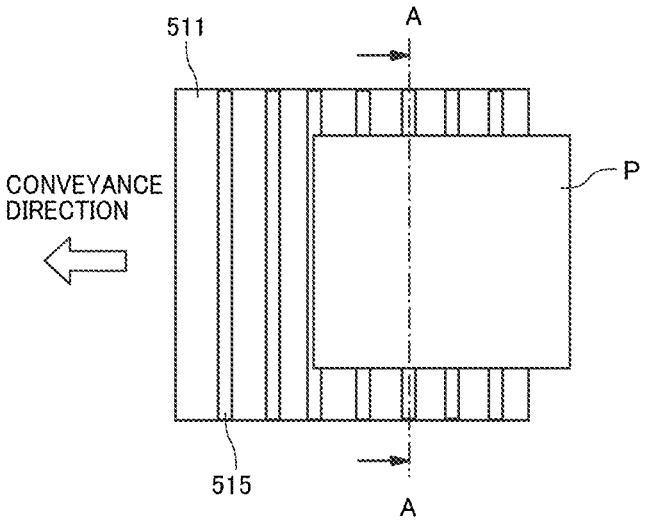
FIGS. 9A and 9B illustrate the conveyance mechanism according to the first embodiment of the present disclosure.
Figure 9B:
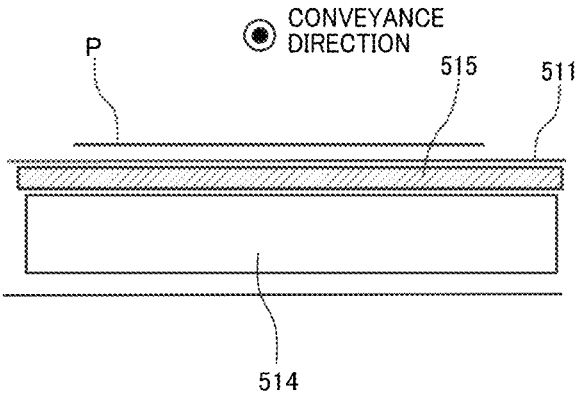

FIGS. 9A and 9B illustrate the conveyance mechanism 501 according to the first embodiment.

FIG. 9A is a schematic plan view of the conveyance mechanism according to the comparative example.

FIG. 9B is a cross-sectional front view of the conveyance mechanism 501 along (corresponding to) a line A-A of FIG. 9A according to the first embodiment.

Figure 10A:
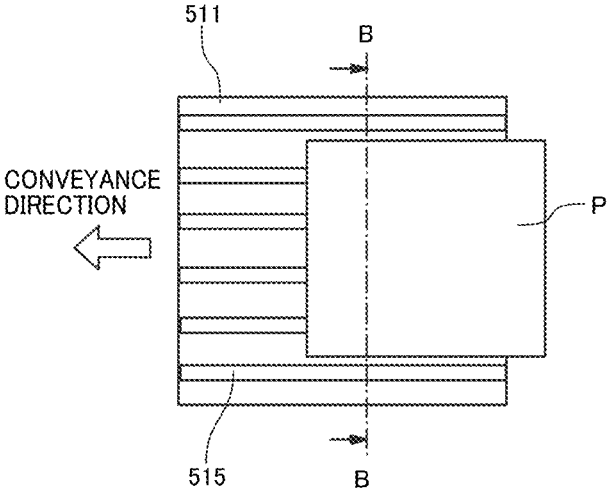
FIGS. 10A and 10B illustrate a conveyance mechanism according to a comparative example.
Figure 10B:
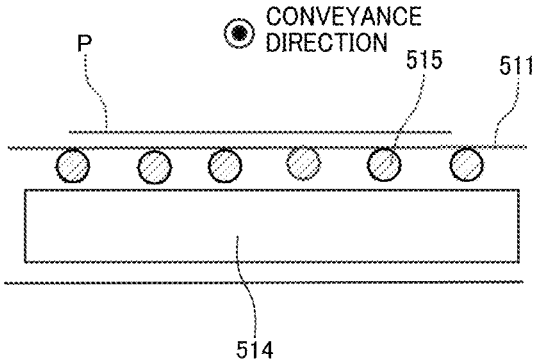

FIGS. 10A and 10B illustrate a conveyance mechanism according to a comparative example.

FIG. 10A is a schematic plan view of the conveyance mechanism according to the comparative example.

FIG. 10B is a cross-sectional front view of the conveyance mechanism 501 along (corresponding to) a line B-B of FIG. 10A according to the comparative example.

Figure 11:
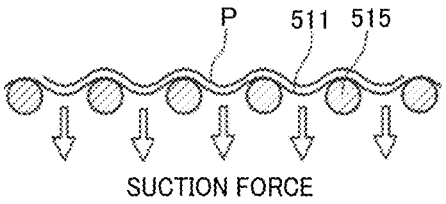
FIG. 11 is a cross-sectional front view of the conveyance mechanism according to the comparative example to illustrate an effect of the conveyance mechanism according to the comparative example.

FIG. 11 is a cross-sectional front view of the conveyance mechanism according to the comparative example illustrating an effect of the conveyance mechanism according to the comparative example.

As illustrated in FIGS. 10A and 10B, the conveyance mechanism according to the comparative example includes multiple supports 515 between the conveyance belt 511 and the suction chamber 514. The multiple supports 515 contact a back surface (lower surface in FIG. 10B) of the conveyance belt 511. Each of the multiple supports 515 extends in the conveyance direction as indicated by arrow in FIG. 10A. Further, the multiple supports 515 are arrayed in the direction perpendicular to the conveyance direction (width direction) as illustrated in FIG. 10B.

In this comparative example, when the sheet P is sucked downward by the suction chamber 514 via the conveyance belt 511, the sheet P becomes a state in which portions of the sheet P between the multiple supports 515 deform (bend) by a suction force generated by the suction chamber 514 as illustrated in FIG. 11. Thus, the sheet P is deformed into an uneven shape in the direction perpendicular to the conveyance direction (width direction).

Since the multiple supports 515 are disposed along the conveyance direction, the sheet P is conveyed by the circulative movement of the conveyance belt 511 without changing positions of the deformed parts (uneven shaped parts) of the sheet P while the sheet P is heated and dried by the heater 502.

Therefore, when the sheet P stretched by the moisture and the moisture of the ink is heated by the heater 502, the moisture of the sheet P is evaporated while the sheet P is deformed into the uneven shape. After the sheet P is dried, the uneven shaped parts (deformed parts) of the sheet P remains and quality of image (image quality) on the sheet P deteriorates.

Conversely, the conveyance mechanism 501 according to the first embodiment includes the multiple supports 515, each of which extends in the direction perpendicular to the conveyance direction (width direction) as illustrated in FIG. 9A. The multiple supports 515 are arranged side by side in the conveyance direction as illustrated in FIG. 9A.

When the sheet P is conveyed by the conveyance belt 511, parts of the sheet P between the multiple supports 515 arrayed in the conveyance direction deform to instantaneously form a concave and convex surface (unevenness) in the sheet P. The sheet P is conveyed while the sheet P repeatedly passes the multiple supports 515 extending in the width direction and repeatedly become a concave and convex state by the circulative movement of the conveyance belt 511. Thus, the sheet P having the concave and convex surface is leveled by the multiple supports 515 extending in the width direction (direction perpendicular to the conveyance direction).

Thus, the conveyance mechanism 501 (sheet conveyor) according to the first embodiment can reduce deformation of the sheet P and prevent the sheet P from having an uneven habit.

Next, a sheet heater 500 according to a second embodiment of the present disclosure is described with reference to FIG. 12.

Figure 12:
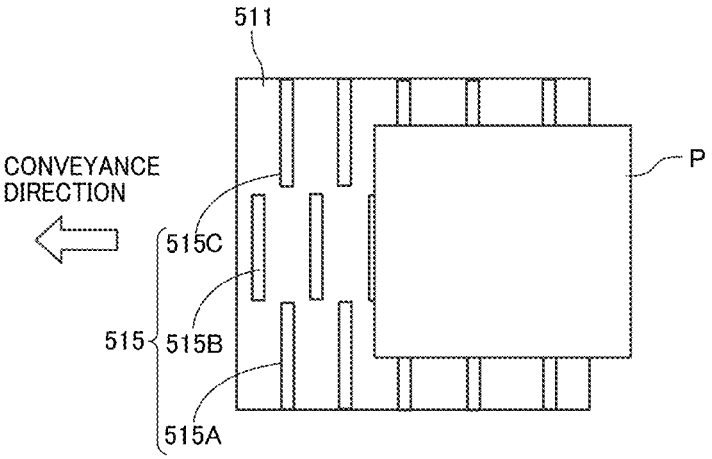
FIG. 12 is a schematic plan view of a sheet conveyor according to the second embodiment of the present disclosure.

FIG. 12 is a schematic plan view of a sheet conveyor according to the second embodiment.

The conveyance mechanism 501 according to the second embodiment includes the multiple supports 515 divided into three portions in a direction intersecting with the conveyance direction. Specifically, the multiple supports 515 includes three groups of multiple supports 515A, 515B, and 515C divided in the direction perpendicular to the conveyance direction (width direction) as illustrated in FIG. 12.

Positions of the groups (arrays) of the multiple supports 515A and 515C on both sides and a position of an array of the multiple supports 515B in a central portion of the conveyance belt 511 in the direction perpendicular to the conveyance direction (width direction) are shifted in the conveyance direction. In each of the groups (arrays) of the multiple supports 515A, 515B, and 515C, the multiple supports are arrayed in the conveyance direction.

Thus, said two or more groups of multiple supports 515A, 515B, and 515C are separated in the direction perpendicular to the conveyance direction (width direction).

Thus, the conveyance mechanism 501 according to the second embodiment includes the groups (arrays) of the multiple supports 515A, 515B, and 515C arranged in a direction perpendicular to the conveyance direction (width direction). Each of the groups (arrays) of the multiple supports 515A, 515B, and 515C includes the multiple supports 515 arrayed in the conveyance direction. The positions of the groups (arrays) of the multiple supports 515A and 515C and the positions of the group (array) of the multiple supports 515B are shifted (staggered) in the conveyance direction.

Thus, a positions of at least one of said two or more groups of multiple supports 515A, 515B, and 515C is shifted from a position of another of said two or more groups of multiple supports 515A, 515B, and 515C in the conveyance direction.

Thus, any part of the sheet P in the direction perpendicular to the conveyance direction (width direction) is reliably sucked by the suction chamber 514 so that the sheet P is stably conveyed.

Further, the multiple supports 515 may be divided into two or more parts (two parts or four or more parts) in the direction intersecting with the conveyance direction. Further, each of a length of the divided supports 515 may be identical or different.

A sheet heater 500 according to a sixth embodiment of the present disclosure is described with reference to FIGS. 13 and 14.

Figure 13:
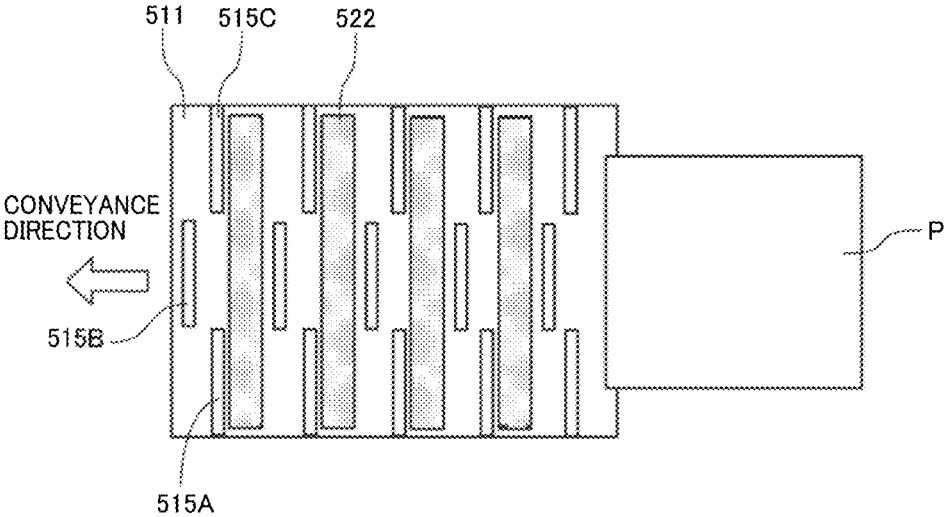
FIG. 13 is a schematic plan view of a sheet heater according to a third embodiment of the present disclosure.

FIG. 13 is a schematic plan view of the sheet heater 500 according to a third embodiment of the present disclosure.

Figure 14:
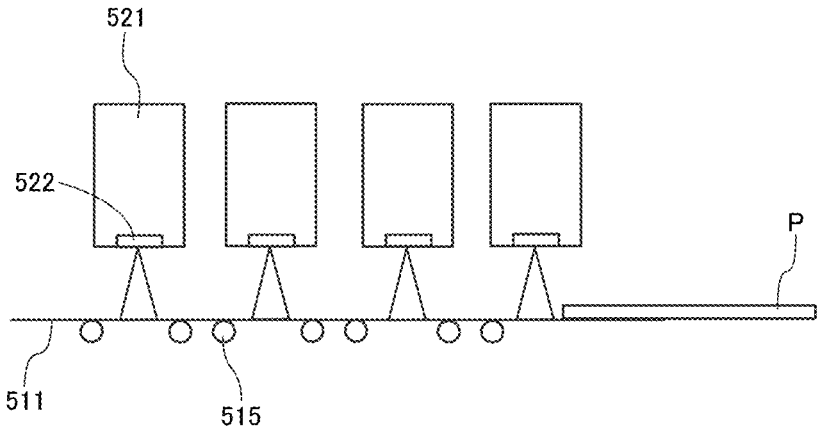
FIG. 14 is a schematic cross-sectional side view of the sheet heater according to the third embodiment of the present disclosure.

FIG. 14 is a schematic cross-sectional side view of the sheet heater 500 according to the third embodiment of the present disclosure.

The sheet heater 500 according to the third embodiment includes the multiple supports 515 disposed in regions other than regions immediately (directly) below the irradiation surface 522 of the ultraviolet irradiators 521 in addition to a configuration of the sheet heater 500 according to the second embodiment as illustrated in FIG. 12. When an infrared irradiator is used as the heating device as the first dryer 40 in FIG. 1, the multiple supports 515 are disposed in a region other than a region immediately (directly) below an irradiation region of the infrared irradiator.

Thus, the multiple supports 515 are not directly heated by ultraviolet irradiation of the ultraviolet irradiators 521 to reduce a partial temperature rise of the conveyance belt 511. Thus, the sheet heater 500 can reduce temperature unevenness, drying unevenness, cockling or the like to stabilize image quality on the sheet P.

Further, the sheet heater 500 can reduce a partial temperature rise of the conveyance belt 511 or the like that conveys the sheet P. Thus, the sheet heater 500 can reduce deformation of the sheet P due to temperature unevenness and partial temperature rise of the conveyance belt 511 to increase durability of the conveyance belt 511.

Next, a sheet heater 500 according to a fourth embodiment of the present disclosure is described with reference to FIGS. 15 to 17.

Figure 15:
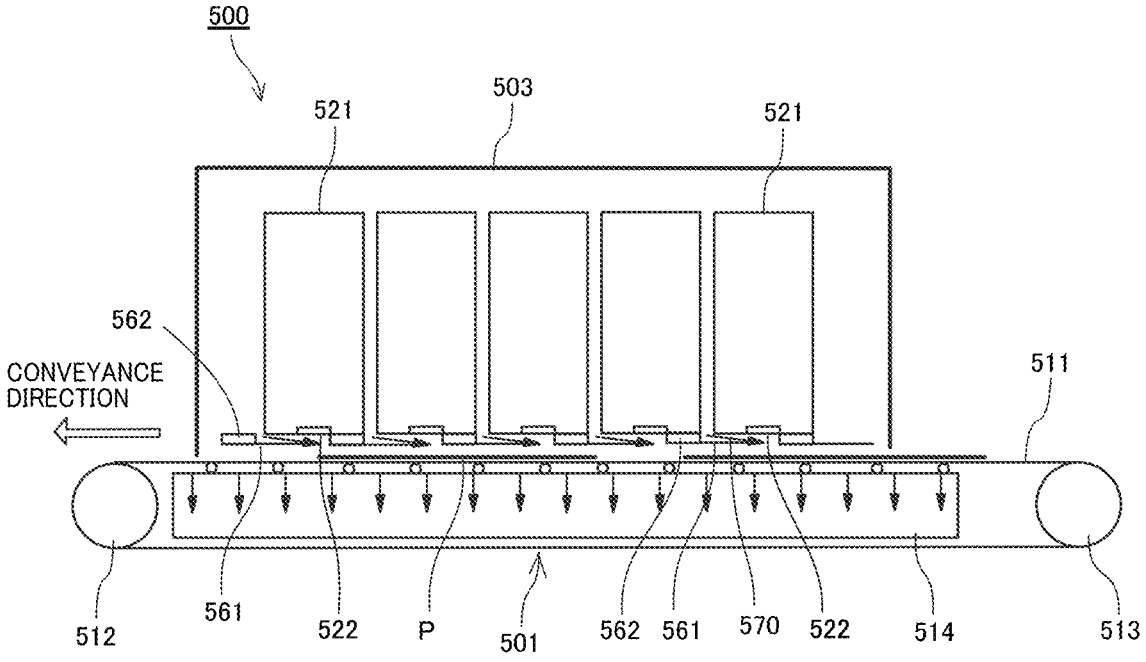
FIG. 15 is a schematic cross-sectional side view of a sheet heater according to a fourth embodiment of the present disclosure.

FIG. 15 is a schematic cross-sectional side view of a sheet heater 500 according to the fourth embodiment of the present disclosure.

Figure 16:
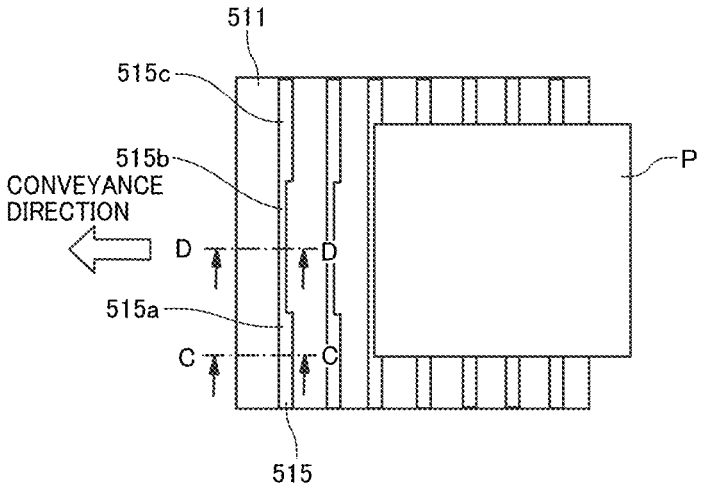
FIG. 16 is a schematic plan view of the sheet heater according to the fourth embodiment of the present disclosure.

FIG. 16 is a schematic plan view of the sheet heater 500 according to the fourth embodiment of the present disclosure.

Figure 17A:
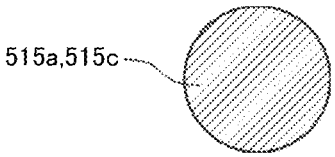
FIGS. 17A and 17B are cross-sectional views of one of multiple supports.
Figure 17B:
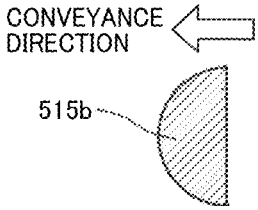

FIGS. 17A and 17B are cross-sectional views of one of the multiple supports 515.

FIG. 17A is a schematic cross-sectional view of one of the multiple supports 515*a* and 515*c* along a line C-C of FIG. 16.

FIG. 17B is a schematic cross-sectional view of a central portion 515*b* of one of the multiple supports 515 along a line D-D of FIG. 16.

The sheet heater 500 according to the fourth embodiment includes a channel plate 561 between the conveyance belt 511 of the conveyance mechanism 501 and the irradiation surface 522 of the ultraviolet irradiator 521 serving as a heating unit.

The channel plate 561 may be, for example, a general metal plate, a reflector to return the light reflected from the sheet P to the sheet P again, or the like. The channel plate 561 is disposed at a position close to the irradiation surface 522 to a degree in which the channel plate 561 does not block the ultraviolet light (UV light) emitted from the irradiation surface 522 of the ultraviolet irradiator 521.

Further, the sheet heater 500 includes an airflow generator 562 to generate an airflow 570 that flows along the irradiation surface 522. The airflow generator 562 is disposed between the irradiation surface 522 of the ultraviolet irradiator 521 as the heating unit and the channel plate 561.

As illustrated in FIG. 17A, each of the multiple supports 515 includes end portions 515*a* and 515*c* and the central portion 515*b* in the direction perpendicular to the conveyance direction (width direction). Both end portions 515*a* and 515*c* of the multiple supports 515 in the direction perpendicular to the conveyance direction (width direction) have a circular cross section in the conveyance direction.

As illustrated in FIG. 17B, the central portion 515*b* has a semicircular cross section only on a downstream side of the central portion 515*b* in the conveyance direction. Conversely, the central portion 515*b* may have the circular cross section as illustrated in FIG. 17A in the conveyance direction, and each of end portions 515*a* and 515*c* may have a semicircular cross section as illustrated in FIG. 17B in the conveyance direction.

An effect of the sheet heater 500 according to the fourth embodiment is described below with reference to FIGS. 15 to 17 and FIG. 18.

Figure 18:
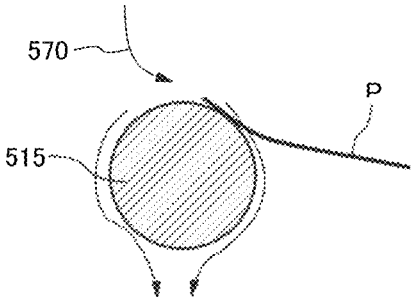
FIG. 18 is a schematic cross-sectional view of the support illustrating an effect of the support according to the fourth embodiment.

FIG. 18 is a schematic cross-sectional view of the support 515 illustrating an effect of the support 515 according to the fourth embodiment.

An airflow 570 generated by the airflow generator 562 flows toward upstream (right side in FIG. 7) of the sheet heater 500 in the conveyance direction as indicated by arrow in FIG. 15 along the irradiation surface 522 of the ultraviolet irradiator and the channel plate 561. Thus, the airflow 570 does not directly hit the sheet P on the conveyance belt 511. Thus, the airflow 570 does not cool the sheet P, and the sheet heater 500 can improve a drying efficiency of the sheet heater 500 to dry the sheet P.

Then, vapor generated from the liquid on the sheet P heated by the ultraviolet irradiation emitted from the ultraviolet irradiator 521 rises toward the irradiation surface 522 of the ultraviolet irradiator 521. However, the airflow 570 blows the vapor to upstream in the conveyance direction so that the vapor does not reach the irradiation surface 522.

Then, the airflow 570 containing the vapor is sucked into the suction chamber 514 by a suction airflow generated by the suction chamber 514 in a region in which the sheet P is not placed on the conveyance belt 511 and then exhausted outside the sheet heater 500.

As described above, the sheet heater 500 blows the airflow 570 along the irradiation surface 522 of the ultraviolet irradiator 521 and sucks and discharges the airflow 570 containing the rising vapor by the suction chamber 514 toward the conveyance belt 511 opposite to the irradiation surface 522. Thus, the airflow 570 is discharged without directly hitting the sheet P on the conveyance belt 511 so that the drying efficiency is improved.

As illustrated in FIG. 18, the airflow 570 is generated to hit the multiple supports 515 to generate an airflow flowing along peripheral surfaces of the multiple supports 515. At this time, if a leading end of the sheet P is positioned on the multiple supports 515, the airflow 570 hits the leading end of the sheet P so that the leading end of the sheet P may be turned up by the airflow 570.

Therefore, the central portion 515*b* of the multiple supports 515 has the semicircular cross section only on the downstream side of the central portion 515*b* in the conveyance direction as illustrated in FIG. 17B. Thus, the airflow 570 becomes a downward flow that prevents floatation of the leading end of the sheet P so that the conveyance mechanism 501 can stably conveys the sheet P.

Next, a sheet heater 500 according to a fifth embodiment of the present disclosure is described with reference to FIGS. 19 to 21.

Figure 19:
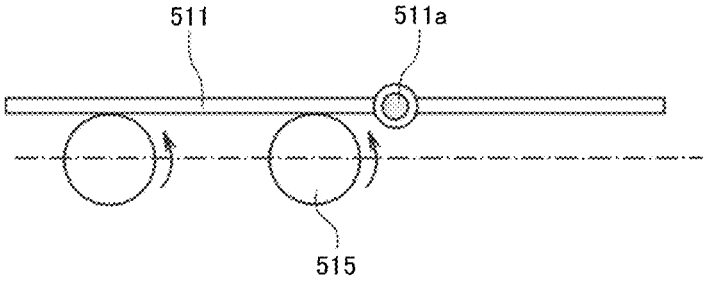
FIG. 19 is a schematic partial cross-sectional side view of a main part of a sheet conveyor (conveyance mechanism) according to a fifth embodiment of the present disclosure.

FIG. 19 is a schematic partial cross-sectional side view of a main part of a sheet conveyor (conveyance mechanism 501) according to a fifth embodiment of the present disclosure.

Figure 20:
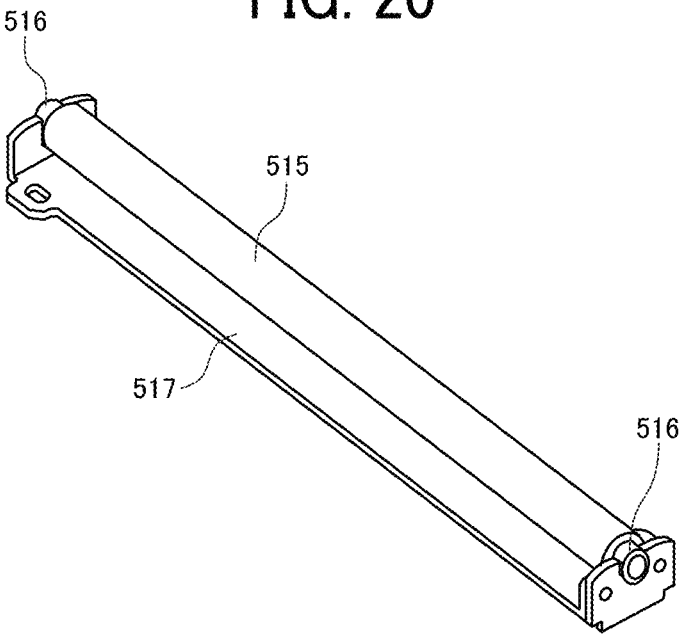
FIG. 20 is an enlarged partial perspective view of one of the multiple supports illustrating an attachment structure of the multiple supports.
Figure 21A:
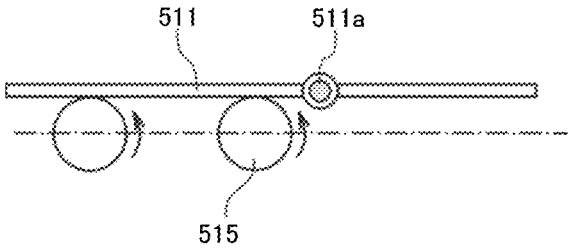
FIGS. 21A to 21D are schematic partial cross-sectional side views of the sheet conveyor (conveyance mechanism) according to the fifth embodiment of the present disclosure to illustrate an effect of the attachment structure of the multiple supports.
Figure 21B:
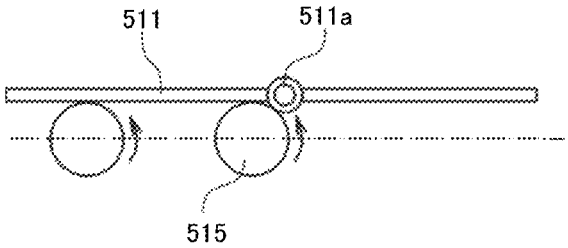
Figure 21C:
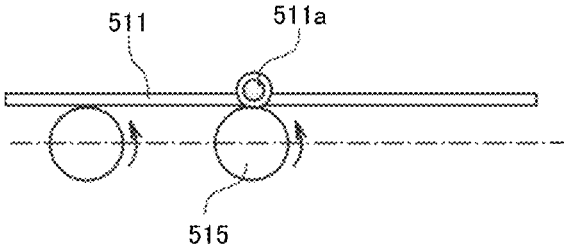
Figure 21D:
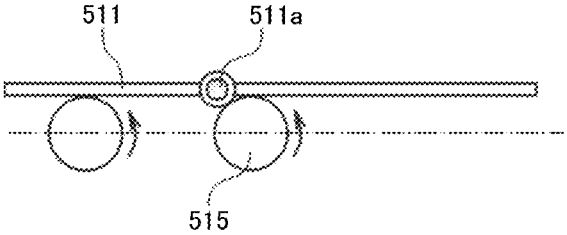

FIG. 20 is an enlarged partial perspective view of one of the multiple supports 515 illustrating an attachment structure of the multiple supports 515.

FIGS. 21A to 21D are schematic partial cross-sectional side views of the sheet conveyor (conveyance mechanism 501) according to a fifth embodiment of the present disclosure to illustrate an effect of the attachment structure of the multiple supports 515.

Both ends of each of the multiple supports 515 are rotatably held by the holder 517 via the bearings 516. Thus, the multiple supports 515 are rotatable.

Thus, the holder 517 and bearings 516 as illustrated in FIG. 20 can reduce sliding resistance between the conveyance belt 511 and the multiple supports 515 when the conveyance belt 511 circulates and moves.

When the conveyance belt 511 includes a joint 511*a* in the conveyance belt 511 as illustrated in FIG. 19, the joint 511*a* of the conveyance belt 511 can smoothly pass through the multiple supports 515 since the multiple supports 515 rotates together with the conveyance belt 511 as illustrated in FIGS. 21A to 21D.

Next, a sheet heater 500 according to a sixth embodiment of the present disclosure is described with reference to FIG. 22.

Figure 22:
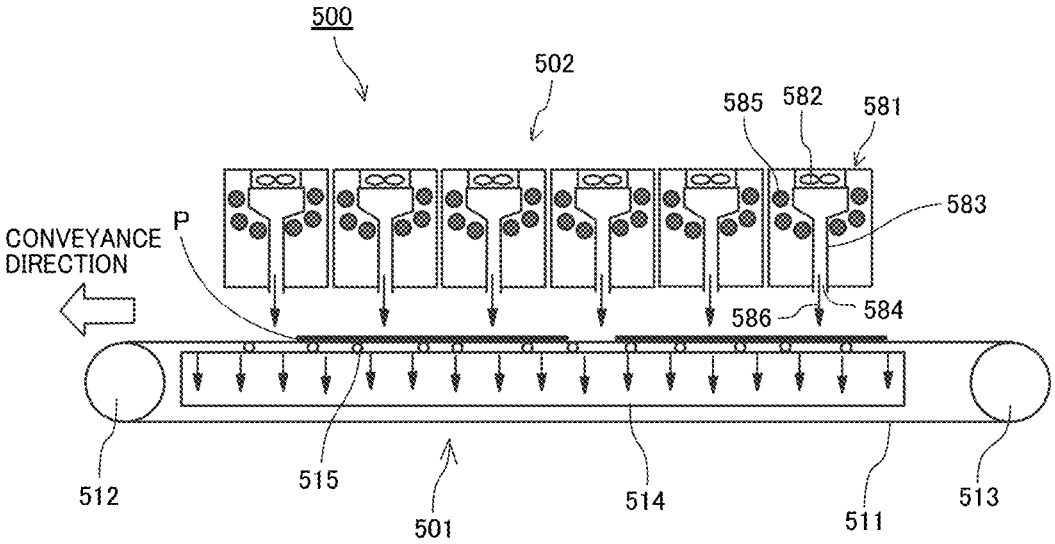
FIG. 22 is a schematic cross-sectional side view of a sheet heater according to a sixth embodiment of the present disclosure.

FIG. 22 is a schematic cross-sectional side view of a sheet heater 500 according to a sixth embodiment of the present disclosure.

The heater 502 of the sheet heater 500 includes air blowers 581. The air blower 581 includes a fan 582, a channel 583, a nozzle 584, and an infrared heater 585. The fan 582 sucks air outside the sheet heater 500. The nozzle 584 is also referred to as a "blowout port".

The air blower 581 heats the air taken inside the channel 583 by the fan 582 with the infrared heater 585 and blows a warm air 586 from the nozzle 584 toward the sheet P through the channel 583. Thus, the air blower 581 reduce a vapor density in a vicinity of the sheet P to promote evaporation of the moisture in the ink while raising the temperature of the solvent and moisture in the ink applied onto the sheet P.

The sheet heater 500 according to the sixth embodiment includes the multiple supports 515 in a region other than a region immediately (directly) below the nozzles 584 of the air blower 581 serving as an air blower as in the third embodiment (see FIGS. 13 and 14).

Thus, the sheet heater 500 can prevent the warm air 586 from hitting the multiple supports 515 to lift the leading end of the sheet P, thereby improving conveyance stability of the sheet heater 500.

It should be noted that the above-described embodiments can be combined with each other as long as there is no contradiction between the above-described embodiments.

In the present embodiments, a "liquid" discharged from the head is not particularly limited as long as the liquid has a viscosity and surface tension of degrees dischargeable from the head.

Preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

Examples of the "liquid discharge apparatus" include, not only apparatuses capable of discharging liquid to materials to which liquid can adhere, but also apparatuses to discharge a liquid toward gas or into a liquid.

The "liquid discharge apparatus" may include units to feed, convey, and eject the material on which liquid can adhere.

The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures.

For example, the liquid discharge apparatus may be an apparatus to form arbitrary images, such as arbitrary patterns, or fabricate three-dimensional images.

The above-described term "material on which liquid can adhere" represents a material on which liquid is at least temporarily adhered, a material on which liquid is adhered and fixed, or a material into which liquid is adhered to permeate.

Examples of the "material on which liquid can adhere" include recording media, such as paper sheet, recording paper, recording sheet of paper, film, and cloth, electronic component, such as electronic substrate and piezoelectric element, and media, such as powder layer, organ model, and testing cell.

The "material on which liquid can adhere" includes any material on which liquid is adhered, unless particularly limited.

Examples of the "material on which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material on which liquid can adhere.

However, the liquid discharge apparatus is not limited to such an apparatus.

For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on a sheet surface to reform the sheet surface, and an injection granulation apparatus in which a composition liquid including raw materials dispersed in a solution is injected through nozzles to granulate fine particles of the raw materials.

The terms "image formation", "recording", "printing", "image printing", and "fabricating" used herein may be used synonymously with each other.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A sheet conveyor comprising:

a conveyance belt configured to convey a sheet on a first surface of the conveyance belt in a conveyance direction;

a suction device configured to suck the sheet onto the conveyance belt;

multiple supports between the conveyance belt and a suction chamber of the suction device in a vertical direction, the multiple supports configured to support a second surface of the conveyance belt; and a heater configured to heat the sheet conveyed by the conveyance belt, the heater comprising multiple irradiators arranged in a housing along the conveyance direction on an opposite side of the conveyance belt than the multiple supports, wherein a longitudinal direction of each of the multiple supports is parallel to a direction intersecting the conveyance direction, wherein the multiple supports are arrayed in the conveyance direction, and disposed in regions other than regions immediately below an irradiation region of the irradiators.

2. The sheet conveyor according to claim 1, wherein the multiple supports include two or more groups of multiple supports arrayed in a direction perpendicular to the conveyance direction, said two or more groups of multiple supports are separated in the direction perpendicular to the conveyance direction, and a position of at least one of said two or more groups of multiple supports is shifted from a position of another of said two or more groups of multiple supports in the conveyance direction.

3. The sheet conveyor according to claim 1, wherein each of the multiple supports has a shape of one of a rod, a shaft, and a linear member.

4. The sheet conveyor according to claim 3, wherein a central portion of each of the multiple supports in the direction intersecting the conveyance direction has a semicircular cross section in the conveyance direction, and both end portions of each of the multiple supports in the direction intersecting the conveyance direction has a circular cross section in the conveyance direction.

5. The sheet conveyor according to claim 3, wherein the multiple supports have curved surfaces contacting the conveyance belt.

6. The sheet conveyor according to claim 3, wherein the multiple supports are rotatable.

7. The sheet conveyor according to claim 1, wherein the conveyance belt is one of a mesh belt and a flat belt each having suction holes.

8. The sheet conveyor according to claim 1, wherein the irradiators comprise infrared irradiators.

9. The sheet conveyor according to claim 1, wherein the irradiators comprise ultraviolet irradiators.

10. A liquid discharge apparatus comprising:

the sheet conveyor according to claim 1; and a liquid application device configured to apply a liquid onto the sheet.

11. A printer comprising:

the sheet conveyor according to claim 1; and a printing unit configured to print an image on the sheet.

* * * * *